US010863612B2

(12) United States Patent
Minea et al.

(10) Patent No.: US 10,863,612 B2
(45) Date of Patent: Dec. 8, 2020

(54) SYSTEM FOR GENERATING A PLASMA JET OF METAL IONS

(71) Applicant: CENTRE NATIONAL DE LA RECHERCHE SCIENTIFIQUE - CNRS -, Paris (FR)

(72) Inventors: Tiberiu Minea, Paris (FR); Thomas Petty, Bourg la Reine (FR); Daniel Lundin, Massy (FR); Charles Ballage, Bures sur Yvette (FR)

(73) Assignee: CENTRE NATIONAL DE LA RECHERCHE SCIENTIFIQUE—CNRS, Paris (FR)

( * ) Notice: Subject to any disclaimer, the term of this patent is extended or adjusted under 35 U.S.C. 154(b) by 0 days.

(21) Appl. No.: 16/479,903

(22) PCT Filed: Jan. 30, 2018

(86) PCT No.: PCT/FR2018/050205
§ 371 (c)(1),
(2) Date: Jul. 22, 2019

(87) PCT Pub. No.: WO2018/138458
PCT Pub. Date: Aug. 2, 2018

(65) Prior Publication Data

US 2019/0373711 A1 Dec. 5, 2019

(30) Foreign Application Priority Data

Jan. 30, 2017 (FR) ..... 17 50750

(51) Int. Cl.
*H05H 1/54* (2006.01)
*H05H 1/32* (2006.01)
*H05H 7/02* (2006.01)

(52) U.S. Cl.
CPC ..... *H05H 1/54* (2013.01); *H05H 1/32* (2013.01); *H05H 2007/022* (2013.01)

(58) Field of Classification Search
CPC ..... H05H 1/54; H05H 1/32; H05H 2007/022
See application file for complete search history.

(56) References Cited

U.S. PATENT DOCUMENTS 4,328,667 A 5/1982 Valentian et al.
2003/0033797 A1 2/2003 Spanjers et al.
(Continued)

OTHER PUBLICATIONS

"Power Sources", Product Engineering, vol. 35, No. 16, p. 75, Aug. 3, 1964.

*Primary Examiner* — Kevin Quarterman
(74) *Attorney, Agent, or Firm* — BakerHostetler

(57) ABSTRACT

A system for generating a plasma jet of metal ions is provided. This system includes a tube made of electrically insulating material containing a metal that is in the solid phase at room temperature and an anode making contact with this metal, a generator connected to this anode that is capable of producing a positive electrical potential at this anode, a heating element that is capable of heating a portion of the metal to a heating temperature Tc that is high enough to vaporize this portion of the metal, an electron source located on the outside of the tube and out of the longitudinal axis of the tube, and being capable of generating an electron stream that is able to ionize the vapor of the metal so as to form metal ions, such that the metal ions thus produced are capable of being accelerated by this potential and ejected out of the tube via the downstream end of the tube, and a portion of which are neutralized by electrons so as to form a plasma stream, the system operating without magnets and without an acceleration grid.

11 Claims, 2 Drawing Sheets

(56) References Cited

U.S. PATENT DOCUMENTS

| | | | | |
|---|---|---|---|---|
| 2004/0183452 | A1* | 9/2004 | Kornfeld | B64G 1/405 315/111.61 |
| 2005/0174063 | A1 | 8/2005 | Kornfeld et al. | |
| 2007/0295701 | A1* | 12/2007 | Bodroghkozy | H05H 1/32 219/121.52 |
| 2009/0066256 | A1 | 3/2009 | Stone et al. | |
| 2010/0289437 | A1* | 11/2010 | Koch | F03H 1/0031 315/506 |
| 2013/0294557 | A1* | 11/2013 | Perkins | H05H 3/06 376/115 |
| 2018/0216605 | A1* | 8/2018 | Rafalskyi | F03H 1/0012 |

* cited by examiner

SYSTEM FOR GENERATING A PLASMA JET OF METAL IONS

CROSS-REFERENCE TO RELATED APPLICATIONS

This application is a National Stage of International patent application PCT/FR2018/050205, filed on Jan. 30, 2018, which claims priority to foreign French patent application No. FR 1750750, filed on Jan. 30, 2017, the disclosures of which are incorporated by reference in their entirety.

FIELD OF THE INVENTION

The present invention relates to a system for generating a plasma jet. Systems for generating a metal plasma from a solid block of this metal are known. Such systems are used to deposit a metal coating on a substrate, in particular a thin-film coating. These systems primarily produce neutral metal vapors, i.e. metal atoms where only a portion thereof is ionized.

BACKGROUND

For example, such a system comprises a vacuum chamber in which a metal block, to which a positive potential is applied so that it becomes an anode, a cathode, which generates electrons, and a substrate that is intended to receive a coating of this metal are placed. The system further comprises a series of magnets which are intended to guide the metal ions formed by the vaporization of the metal.

In such a system, the electrons emitted as a beam by the cathode are attracted to the metal block forming the anode. Under the effect of the bombardment by the electrons of this beam and the resulting local and intense increase in temperature, a portion of the block melts and is transformed into metal gas. The atoms of this gas are then partially ionized by the electron stream emitted by the cathode and form a plasma of positive metal ions and electrons. These positive metal ions are accelerated toward the cathode and toward the substrate, which is also at a negative potential. The cathode is generally annular in shape, such that the ions, guided by the series of magnets arranged around the path between the metal block and the substrate, pass through the cathode and strike the substrate so as to form a metal coating.

Such a system has drawbacks, however.

Specifically, the electron emitter is placed in the path of the stream of metal ions, and is therefore gradually damaged by this stream, in particular because of the formation of an unwanted deposit of metal ions on the emitter. The service life of the emitter, and hence of the plasma generation system, is therefore decreased.

Moreover, the use of magnets, which is necessary to form a concentrated and directional stream of metal ions (plasma), makes the system for generating a plasma more complex. Additionally, a device for cooling the magnets must be incorporated within the system in order to prevent the magnets from being heated above their Curie temperature under the effect of the plasma.

SUMMARY OF THE INVENTION

The present invention aims to overcome these drawbacks.

The invention aims to provide a system for generating a plasma jet comprising metal ions which is capable of generating a directional stream, the service life of which is improved, the manufacture of which is simplified and which operates without magnets.

This aim is achieved by virtue of the system for generating a plasma jet comprising a tube made of electrically insulating material containing a metal that is in the solid phase at room temperature and an anode making contact with this metal, a generator connected to the anode that is capable of producing a positive electrical potential at this anode, a heating element that is capable of heating a portion of the metal to a heating temperature Tc that is high enough to vaporize this portion of the metal, an electron source located on the outside of the tube and out of the longitudinal axis of the tube, and being capable of generating an electron stream that is able to ionize the vapor of the metal so as to form metal ions, such that the metal ions thus produced are capable of being repelled and thus accelerated by this potential and ejected out of the tube via the downstream end of the tube, and a portion of which are neutralized by electrons so as to form a plasma stream, the system operating without magnets and without an acceleration grid.

By virtue of these arrangements, the system for generating a plasma jet is simplified because no magnets are used to direct the plasma stream. Instead, it is the specific distribution of the electric field within and in proximity to the tube which directs the plasma.

Moreover, since the electron source is located on the outside of the tube and out of its longitudinal axis, it is not damaged by the plasma beam. The service life of the plasma generation system is therefore increased.

Advantageously, the atomic mass of the metal used is higher than or equal to that of gold or the melting point of the metal used is lower than or equal to that of gold.

The system according to the invention may operate with a metal whose melting point is lower than that of other metals, since the system does not use a concentrated electron beam which heats the metal very intensely and hence vaporizes it overly quickly, unlike in the existing systems.

Advantageously, the heating element surrounds the downstream portion of the tube.

Advantageously, the tube is made of ceramic, providing electrical and thermal insulation.

Advantageously, the anode is distinct from the metal contained in the tube.

Advantageously, the electron source comprises the heating element.

Advantageously, the electron source comprises an external electron emitter that is distinct from the heating element.

The invention also relates to a method for generating a plasma jet, which comprises the following steps:

(a) a tube made of electrically insulating material containing a metal that is in the solid phase at room temperature, an anode making contact with said metal, an electrical generator connected to said anode and an electron source located on the outside of the tube are provided;

(b) a positive electrical potential is applied to the anode using the generator;

(c) a portion of the metal is heated to a heating temperature Tc that is high enough to vaporize this portion of the metal;

(d) the metal vapor thus produced is ionized by the electrons emitted by the electron source so as to form metal ions that are accelerated by this potential and ejected out of the tube via the downstream end of the tube after a portion of them have been neutralized by electrons so as to form a plasma stream, the method using no magnets, no acceleration grid and no gas as an initial source of matter to be ionized.

For example, the generator delivers a DC electric current.

For example, the generator delivers pulses generating an electric current.

BRIEF DESCRIPTION OF THE DRAWINGS

The invention will be better understood and its advantages will become more clearly apparent on reading the following detailed description of one embodiment provided by way of nonlimiting example. The description makes reference to the appended drawings, in which.

DETAILED DESCRIPTION

In the following description, the terms "inside" and "outside" refer to the region inside and outside the tube, respectively. The terms "upstream" and "downstream" refer to the portions of the tube and of the metal cylinder in relation to the direction of flow of the ions through the tube.

Figure 1:
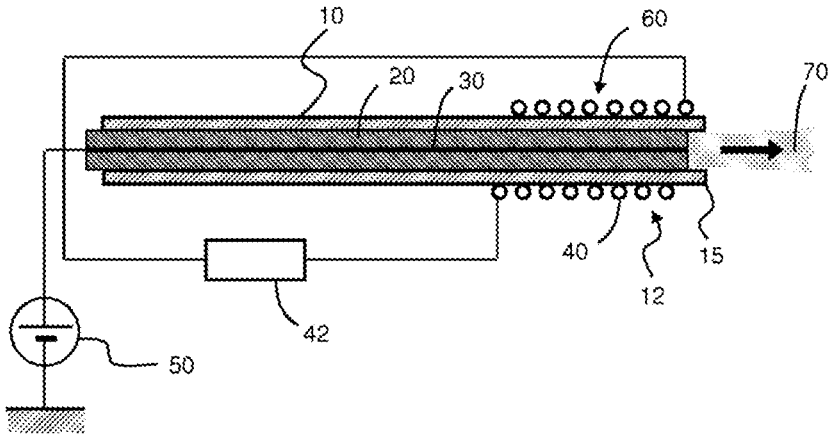
FIG. 1 is a longitudinal sectional view of the system according to the invention.

As shown in FIG. 1, the system according to the invention includes a tube 10 containing a metal cylinder 20 that supplies the metal atoms which are immediately ionized by the high electron current density, the expulsion of which out of the tube constitutes the plasma jet. In the following description, this metal is referred to as the "plasma metal" in order to differentiate it from other metals used in the system.

The tube 10 is made of a material whose melting point is higher than the melting point Tf of the plasma metal 20. For example, the tube 10 is made of ceramic. This ceramic is for example an aluminum oxide, or a boron nitride.

The tube 10 is electrically insulating.

A heating element 40 surrounds at least the downstream portion 12 of the tube 10. This heating element 40 is supplied with power by a heating source 42. For example, the heating element 40 surrounds the entire tube 10. The heating element is for example a filament wound helically around the tube 10 in order to form a coil.

The system according to the invention also includes an electron source 60.

This electron source is needed to balance the positive charge of the ions emitted by the plasma metal 20, such that the particles emitted by the system and used for thrust are electrically neutral overall, downstream of the cylinder.

What is meant by electrically neutral "overall" is that the stream exiting the tube is a mixture of positive ions, electrons and atoms, forming a plasma. The neutrality of the plasma jet thus allows its strongly directional character to be maintained.

In a first embodiment, the heating element 40 emits electrons, and therefore represents the totality of the electron source 60. This is the case when the heating element 40 is a filament. This filament is for example made of tungsten.

Since the heating element 40 is the sole electron source 60, the manufacture of the system is simplified, as the system does not comprise a separate electron source.

In this embodiment, the heating element 40 is a cathode (it is negatively charged).

Figure 2:
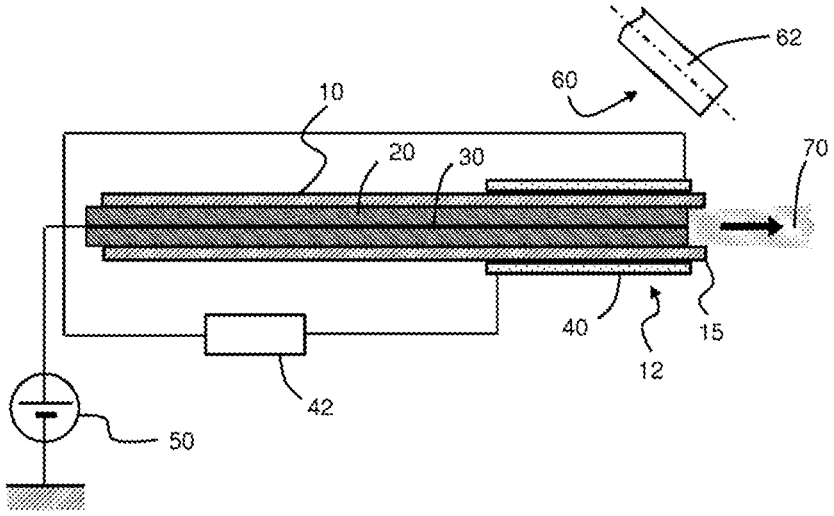
FIG. 2 is a longitudinal sectional view of another embodiment of the system according to the invention.

In a second embodiment, the heating element 40 does not emit electrons. In this case, an electron source 60 that is distinct from the heating element 40, and outside the tube 10, is required. This situation is shown in FIG. 2. The heating element 40 is a ring that surrounds the downstream portion 12 of the tube 10.

The electron source 60 is an external emitter 62, which is a cathode located in proximity to the downstream end 15 of the downstream portion 12 of the tube 10, or an arc generator.

The external emitter 62 is the only cathode of the system. In this case, the heating element 40 is for example made of a material such as a Ni—Cr alloy (for example Nichrome 8), an Fe—Cr—Al alloy (such as Kanthal®) or a cupronickel.

According to a third embodiment, both the heating element 40 and the external emitter 62 are a cathode. The electron source 60 is then made up of the heating element 40 and the external emitter 62.

Whichever the case, the electron source is located outside the tube 10 and out of the longitudinal axis of the tube 10.

In the case in which the cathode is heated indirectly, the heating element 40 is for example made of a material such as lanthanum hexaboride, cerium hexaboride, or mixtures of barium, strontium and calcium oxides.

Alternatively, in the case in which a cathode is heated directly, the heating element 40 is surrounded by an electrical insulator.

The system includes an anode 30 (which is positively charged) that makes contact with the plasma metal 20 when this metal is in the solid phase. The anode 30 therefore makes contact with the plasma metal 20 located in the tube 10.

According to one embodiment, illustrated in FIG. 1, the anode 30 is distinct from the plasma metal 20 and is located inside the tube 10. The anode 30 is made of a conductive material that remains solid while the system for generating a plasma jet is in operation. Thus, the anode 30 is a metal with a melting point that is substantially higher than that of the plasma metal 20. For example, the anode is made of tungsten, tantalum, molybdenum, rhenium, or an alloy of these metals.

The anode 30 is a wire that extends through the center of the cylinder of plasma metal 20, from its upstream end to its downstream end.

An electrical generator 50 is connected to the anode 30 and keeps the anode 30 at the positive electrical potential.

The anode 30 may take any geometry, for example one or more wires embedded in the plasma metal 20, or a grid embedded in the plasma metal 20, or a grid lining the inner face of the tube 10. Whatever its geometry, the anode 30 still makes contact with the plasma metal 20, which keeps the electron stream flowing into the plasma metal 20.

This embodiment has the advantage of the application of the electrical potential to the plasma metal 20 being maintained even when a portion of the plasma metal 20 has transitioned to the liquid phase.

Another advantage is that, in the event of droplets of metal forming downstream of the cylinder of plasma metal 20 as it is partially vaporized, the electrical connection to the anode 30 is still maintained. Specifically, these droplets are liable to interfere with this electrical connection.

Alternatively, the anode 30 is formed by the plasma metal 20 itself.

The expression "anode makes contact with the metal" is understood to refer both to the embodiment in which the anode is an element that is distinct from the metal and makes contact with the metal and to the embodiment in which the anode is formed by the metal.

Advantageously, the cylinder of plasma metal 20 is fed in continuously, i.e. the cylinder 20 slides through the tube 10 from upstream to downstream such that its solid, downstream end is always located substantially at the same position in the tube 10 as the plasma metal 20 located at the downstream end 15 of the tube 10 is vaporized. For example, the cylinder of plasma metal 20 is fed from a reel.

The plasma metal 20 is solid at room temperature and pressure (approximately 20° C., 1 atmosphere). The plasma generation system according to the invention preferably uses a plasma metal 20 whose atomic mass is higher than or equal to that of gold (the atomic mass of which is 197), or whose melting point is lower than or equal to that of gold (1064° C.).

For example, the plasma metals are chosen from lead (atomic mass 207, melting point 327° C.), bismuth (atomic mass 208, melting point 271° C.), tin (melting point 232° C.), zinc (melting point 420° C.), tellurium (melting point 450° C.), indium (melting point 156° C.) and thallium (atomic mass 204, melting point 303° C.).

Advantageously, the melting point of the plasma metal 20 is lower than 500° C.

Advantageously, the atomic mass of the plasma metal 20 is higher than or equal to that of gold, and the melting point of the plasma metal 20 is lower than or equal to that of gold.

The use of metals with high atomic weights affords several advantages.

Specifically, the melting points of these metals are lower than those of other metals.

The heating temperature required to melt these metals, which is at most of the order of the melting point Tf of the metal, is then lower, which makes it possible to omit a device for cooling the tube 10.

Moreover, the power needed to heat the plasma metal 20 and to produce the ions is lower, requiring a smaller energy expenditure. In the plasma jet generated by the system according to the invention, the only ions are metal ions.

However, the system according to the invention may be used in a space vehicle propulsion system. Specifically, the ejection of the plasma generates a moment which may be used to provide thrust (see the description of propulsion systems below). Thus, the higher the atomic mass of the plasma metal 20 (in particular if it is higher than that of xenon, whose atomic mass is 131), the more the impulse generated by expelling this metal is higher than that generated when xenon is used, for the same ionization state.

Furthermore, a metal with a high atomic mass has a first ionization potential that is lower than for other materials. For example, it is 6.1 eV for thallium, 7.4 eV for lead and 9.2 eV for gold, which is lower than the ionization potential of xenon (12.1 eV). Thus, the probability of ionizing these metals is higher than that of ionizing xenon.

Moreover, a metal with a high atomic mass has a greater probability of being doubly ionized, i.e. it loses two electrons in forming metal ions. Thus, for the same electrical power, an ion of this metal is accelerated faster than those ions which have lost only one electron, as is generally the case for xenon. For example, the double ionization potentials of lead (15 eV), of thallium (20.4 eV) and of gold (20.2 eV) are lower than the double ionization potential of xenon (21 eV).

The invention also relates to a plasma generation method, the operation of which is described below.

The cylinder of plasma metal 20, in the solid phase, is placed in the tube 10. The plasma metal 20 is next heated by the heating element 40, supplied with power by the heating source 42, to a heating temperature Tc that is high enough to vaporize the downstream end of the cylinder of plasma metal 20. The heating temperature Tc is therefore much higher than room temperature. At the same time, the plasma metal 20 has a nonzero positive potential applied to it by the generator 50 (either directly or via the anode 30 making contact with the plasma metal 20).

The metal gas resulting from this vaporization is ionized by the electrons emitted by the electron source 60 (which is either the heating element 40, the external emitter 62 or both). These metal ions are repelled by the metal cylinder 20 since they are also positively charged, and are accelerated in the direction of the downstream end 15 of the tube 10. Moreover, these metal ions, which form a plasma, collide with the electrons emitted by the electron source 60 such that the plasma stream 70 emitted by the tube 10 at its downstream end 15 is partly a stream of electrically neutral metal particles, partly a stream of metal ions and partly a stream of electrons. The direction of propagation of the stream 70 is indicated by an arrow in FIGS. 1 and 2.

Thus, the metal ions are accelerated and then ejected from the tube 10, and as they are ejected some of these metal ions are neutralized through collisions with the electrons emitted by the electron source 60. Those metal ions which are neutralized are transformed into electrically neutral metal particles.

The system according to the invention does not include a grid for accelerating ions, unlike HC thrusters (see below). Specifically, these grids are not needed because the ions are repelled by the anode and accelerated under a sufficiently high positive voltage (see explanation below). Thus, the manufacture of the system is simplified.

The system according to the invention does not include magnets, unlike HE thrusters (see below). The system therefore uses no magnetic field generated by magnets to act on the electrons, or on the ions ejected from the metal. The system is therefore simpler and less expensive to manufacture.

The system according to the invention is therefore more compact than other systems, of the prior art. For example, the length of the system is of the order of 10 cm, and it is less than 1 cm, for example equal to 0.5 cm, in diameter.

Since the tube 10 is heated as the system is in operation, the particles of metal vapor which might have been deposited on the inner surface of the downstream portion of the tube 10 will easily be vaporized and will debond from the surface during future operation. Thus, the tube 10 does not get clogged by deposits.

Advantageously, the system according to the invention operates with DC current generated by the generator 50, which avoids interference with electronic components that might be located in proximity to the system, which could occur if radiofrequency or high frequencies were used.

The potential applied to the anode 30 by the generator 50 is of the order of several hundreds of volts. The intensity of the current is of the order of 1 amp or more, and may reach for example 5 A or more in pulsed mode.

Figure 3:
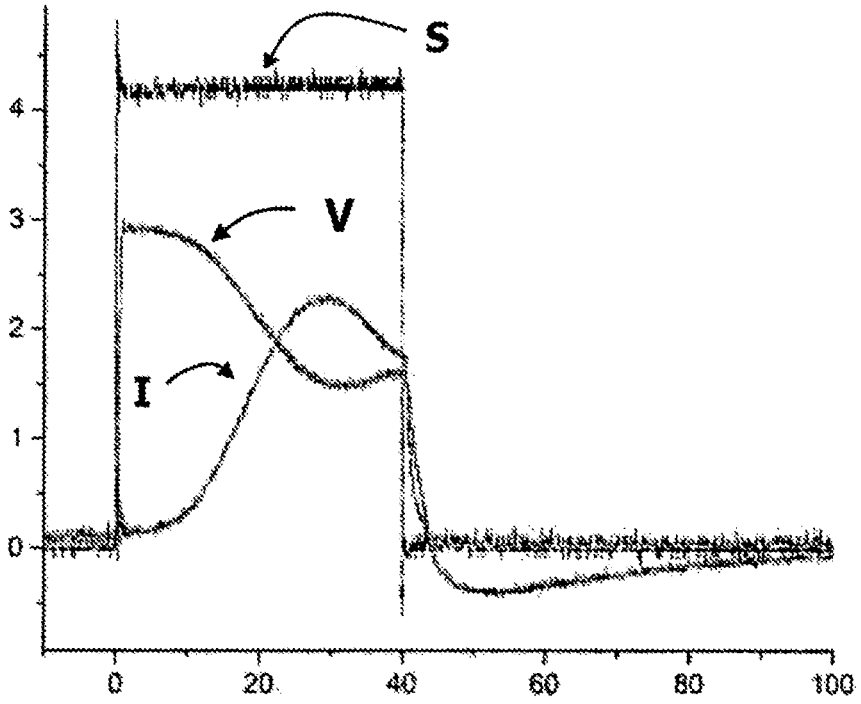
FIG. 3 is a graph showing the variation, with time, of certain quantities when the system according to the invention is operating with a series of electric pulses.

Alternatively, the system operates with a series of electric pulses (pulsed current), using a pulse generator. This operating mode has the advantage of providing higher thrust in the case in which the system according to the invention is used in a space vehicle propulsion system (see below). The pulse generator is supplied with power by the generator 50. Tests carried out by the inventors demonstrate that it is possible to achieve a stable current of 2 A (amperes) with an average voltage jump of 2 kV (kilovolts), which provides, on each pulse, a power of 4 kW (kilowatts) per pulse. The duration of the pulse is variable between 10 and a few hundreds of microseconds. In the operating example given in FIG. 3, the duration of the pulse is about 40 μs (microseconds). The curve denoted by S represents the signal of the pulse (in volts), the curve denoted by V represents the discharge potential at the anode (in kilovolts) and the curve denoted by I represents the discharge current at the anode (in amperes). The duration of the pulse is 40 μs (microseconds), the unit on the abscissa axis of FIG. 3 being in microseconds.

This power generates a thrust that is much higher than that obtained with HE thrusters, for the same payload (see below).

Moreover, using higher-power pulse generators additionally allows the current, and hence the plasma jet, to be increased, and multiple ionizations to be performed, which is very useful in the case of the system being used for such a purpose.

Furthermore, the system allows moment to be transferred efficiently to heavy ions, which increases with the voltage applied to the anode.

Unlike the systems of the prior art which exclusively use an external electron source (cathode) and for which an arc is formed between the cathode and the anode, the system according to the invention does not operate in standard arc mode. Instead, the voltage supplied initially is of the order of several thousands of volts, and is maintained at several hundreds of volts after the formation of the arc (breakdown effect). The high value of this voltage, even after breakdown (in comparison with the standard arc mode in which the voltage is below 100 V), is due to the formation, at the downstream outlet of the tube 10, of a plasma ball, the surface of which is the front of a shockwave generated by the expansion of the ion stream into the vacuum. Thus, this front is highly electrically charged, which contributes to accelerating the metal ions ejected by the cylinder of plasma metal 20. To differentiate this operating mode from the standard arc mode, it will be referred to as the "anomalous arc" mode.

It is this particular operation of the acceleration system according to the invention that makes it possible to avoid the use of grids for accelerating ions in the case in which the system according to the invention is used in a space vehicle propulsion system (see below).

Advantageously, once the plasma has been generated from the cylinder of metal 20 as explained above, it is possible, under certain conditions, to switch off the heating source 42 while the anomalous arc continues to operate. Specifically, the metal ions are naturally repelled by the anode, and, in the steady state, the plasma is self-sustaining with heating sustained by the discharge current (i.e. the electrons of the plasma which flow to the anode), especially for high-current modes. Thus, the formation of a perpetual anomalous arc in vacuum is maintained between the cathode and the anode. In this case, an external electron emitter 62 is used as an electron source only for emitting electrons that are used to neutralize the ion plasma toward the downstream end 15 of the tube 10.

Advantageously, when the anomalous arc is maintained, it is possible to keep the cathode operating without additional heating. This operating mode of the plasma generation system has the advantage that, in the steady state, the electron source 60, in this instance the external emitter 62, may operate with lower electrical power consumption.

Advantageously, the plasma generation system (and method) according to the invention are used in a space vehicle propulsion system, the ejection of the plasma propelling this vehicle.

For propelling a space vehicle, such as a satellite, through space, Hall-effect thrusters (or HE thrusters) are known. This thruster includes an annular space having a bottom at one end and being open at the other end, within which a magnetic field is established. A cathode, which emits electrons, is located at the open end of the annular space and often operates with a gas supply (hollow cathode). The bottom of the annular space constitutes an anode, through which atoms of xenon or another propellant gas, often stored in liquid form, are injected. The electrons emitted by the cathode are trapped at the inlet of the annular space by the magnetic field, where they build up, some of the electrons following their paths towards the anode. The atoms of propellant gas are ionized through collision with the electrons in the annular space, and are accelerated by the electric field in the direction of the open end of this space. At the outlet of this space, the ions are neutralized by passing through the electron cloud and are ejected from the space in the form of a neutral plasma. The ejection of this plasma provides the space vehicle with thrust.

To decrease the weight of the propulsion system, it is sought to decrease the size thereof. However, this decrease involves increasing the magnetic field in order to maintain the same output, which involves additional power consumption, and often the need for a system for cooling the magnets so as not to exceed the Curie temperature or the use of electromagnets which consume a lot of power.

Consequently, propulsion systems operating without magnetic fields, in particular the hollow cathode thruster (or HC thruster), have been developed.

In an HC thruster, a gas is injected through a tube (hollow cylinder) forming the anode, the inner surface of which is covered with a material that emits electrons when it is heated (thermionic emission). Thus, heating the tube results in the gas being ionized as it passes through the tube. The ions thus formed are next accelerated by the difference in potential between the anode and the cathode, which is located at the end of the tube opposite that via which the gas is injected.

The HC thruster has drawbacks.

Specifically, the HC thruster operates with a small potential difference (around 30 V) and hence an intrinsically low thrust. Accelerating the ions faster in order to obtain a higher thrust requires voltages of several hundreds of volts, which involves the use of polarized grids. These grids are placed downstream of the tube. This makes the propulsion system more complex. Moreover, these grids, being subjected to the stream of accelerated ions, become worn, which decreases their long-term effectiveness.

Thus, by using, in the propulsion system, a system for generating a plasma jet such as described above and in which it is the plasma stream 70 that propels the space vehicle, the propulsion system is simplified since it is not necessary to deposit a coating of an additional material, as an electron source, on the inner face of the tube. Specifically, the electron source is located outside the tube.

According to the invention, the initial source (precursor material) of matter for the ions (matter to be ionized) is, at room temperature, neither a gas nor a liquid, but a solid. In other words, the precursor material used by the system according to the invention before the start of its operation, hence before this precursor material is heated, is a solid metal.

Using a solid metal as the initial source of matter for the ions instead of a gas such as xenon or a liquid makes it possible to simplify manufacture and to decrease the mass (payload) of the propulsion system since it is no longer necessary to use pressurized gas tanks with temperature control, and the associated equipment (gas flow pipes, valves).

The acceleration potential for the ions of the propulsion system is higher than that of HC thrusters and the ions are accelerated under a sufficiently high voltage (see explanation above), thereby making it possible to avoid using polarized grids and therefore to decrease the weight of the system, and hence to increase the efficiency thereof.

The system therefore operates without acceleration grids.

The system operates without magnets hence without magnetic fields, unlike HE thrusters. The system is therefore simpler and less expensive to manufacture.

The system according to the invention is therefore more compact than other systems, of the prior art. For example, the length of the system is of the order of 10 cm, and it is less than 1 cm, for example equal to 0.5 cm, in diameter.

The system according to the invention may also be used for other applications, such as the production of multiply charged heavy ions for particle accelerators, or for heavy-ion thermonuclear fusion. The system according to the invention thus advantageously replaces the existing systems for producing heavy ions, which use magnetic fields.

In accelerators, the pulses produced by the generator are high-power pulses, of the order of several hundreds of kV.

The invention claimed is:

1. A system for generating a plasma jet comprising: a tube made of electrically insulating material containing a metal that is in the solid phase at room temperature and an anode making contact with said metal in solid phase, an electrical generator connected to said anode that is capable of producing a positive electrical potential at said anode, a heating element that is capable of heating a portion of said metal to a heating temperature Tc that is high enough to vaporize said portion of the metal, an electron source located on the outside of the tube and out of the longitudinal axis of the tube, and being capable of generating an electron stream that is able to ionize the vapor of said metal so as to form metal ions, such that the metal ions thus produced are capable of being repelled and thus accelerated by this potential and ejected out of said tube via the downstream end of said tube, and a portion of the metal ions are neutralized by electrons so as to form a plasma stream, said system operating without magnets and without an acceleration grid.

2. The system for generating a plasma jet as claimed in claim 1, wherein the atomic mass of said metal is higher than or equal to that of gold, or the melting point of said metal is lower than or equal to that of gold.

3. The system for generating a plasma jet as claimed in claim 1, wherein said heating element surrounds the downstream portion of said tube.

4. The system for generating a plasma jet as claimed in claim 1, wherein said tube is made of ceramic.

5. The system for generating a plasma jet as claimed in claim 1, wherein the anode is distinct from the metal contained in said tube.

6. The system for generating a plasma jet as claimed in claim 1, wherein said electron source comprises said heating element.

7. The system for generating a plasma jet as claimed in claim 1, wherein said electron source comprises an external electron emitter that is distinct from said heating element.

8. A propulsion system for a space vehicle comprising: a system for generating a plasma jet as claimed in claim 1, the ejection of said plasma generating a thrust.

9. A method for generating a plasma jet comprising the following steps:

a) a tube made of electrically insulating material containing a metal that is in the solid phase at room temperature, an anode making contact with said metal in solid phase, a generator connected to said anode and an electron source located on the outside of the tube and out of the longitudinal axis of the tube are provided;

b) a positive electrical potential is applied to said anode using said generator;

(c) a portion of said metal is heated to a heating temperature Tc that is high enough to vaporize said portion of the metal;

(d) the vapor of said metal thus produced is ionized by the electrons emitted by said electron source so as to form metal ions that are accelerated by said potential and ejected out of said tube via the downstream end of said tube, and a portion of which are neutralized by electrons so as to form a plasma stream, said method using no magnets and no acceleration grid.

10. The method for generating a plasma jet as claimed in claim 9, wherein said generator delivers a DC electric current.

11. The method for generating a plasma jet as claimed in claim 9, wherein said generator delivers pulses generating an electric current.

* * * * *